US008404053B2

(12) United States Patent
Prince

(10) Patent No.: US 8,404,053 B2
(45) Date of Patent: Mar. 26, 2013

(54) DEVICE AND METHOD FOR REMOVING PARTICULATES FROM A KEYBOARD

(76) Inventor: Michael D Prince, Chicago, IL (US)

( * ) Notice: Subject to any disclaimer, the term of this patent is extended or adjusted under 35 U.S.C. 154(b) by 0 days.

(21) Appl. No.: 13/118,104

(22) Filed: May 27, 2011

(65) Prior Publication Data

US 2012/0023691 A1 Feb. 2, 2012

Related U.S. Application Data

(63) Continuation-in-part of application No. 29/366,872, filed on Jul. 30, 2010, now Pat. No. Des. 663,124.

(51) Int. Cl.
*B08B 7/00* (2006.01)

(52) U.S. Cl. ..... 134/6; 15/143.1

(58) Field of Classification Search ..... None
See application file for complete search history.

(56) References Cited

U.S. PATENT DOCUMENTS

| | | | | |
|---|---|---|---|---|
| D19,030 | S | 4/1889 | Lee | |
| 581,323 | A | 4/1897 | Wright | |
| D49,548 | S | 8/1916 | Richard, Jr. | |
| 2,194,916 | A * | 3/1940 | Somers | 401/22 |
| 2,703,898 | A | 3/1955 | Kellett | |
| 4,600,328 | A | 7/1986 | Clements | |
| 4,864,677 | A | 9/1989 | Levy | |
| 5,299,341 | A * | 4/1994 | Wakao | 15/210.1 |
| D377,121 | S | 1/1997 | Lee | |
| D400,408 | S | 11/1998 | Schulze | |
| 6,298,514 | B1 | 10/2001 | Lazich et al. | |
| D454,254 | S | 3/2002 | Hellinger et al. | |
| D454,804 | S | 3/2002 | Zuniga | |
| D484,879 | S | 1/2004 | Jones | |
| D485,269 | S | 1/2004 | Jones et al. | |
| D489,069 | S | 4/2004 | Lin | |
| D494,571 | S | 8/2004 | Polito | |
| D499,086 | S | 11/2004 | Polito | |
| D504,020 | S | 4/2005 | Willette | |
| D518,907 | S | 4/2006 | Leung | |
| D536,529 | S | 2/2007 | Antler | |
| D544,480 | S | 6/2007 | Murakami | |
| D564,231 | S | 3/2008 | Huang | |
| D568,050 | S | 5/2008 | Huang | |
| D615,985 | S | 5/2010 | Landry et al. | |
| 7,766,572 | B2 | 8/2010 | Tranchant et al. | |
| D628,579 | S | 12/2010 | Landry et al. | |
| 7,845,041 | B2 | 12/2010 | Gatzemeyer et al. | |

(Continued)

FOREIGN PATENT DOCUMENTS

WO WO 2005055761 A1 * 6/2005

OTHER PUBLICATIONS

Eric Beare Design Catalog, p. 14, Computer Accessories, [online], [retrieved on Oct. 22, 2009]. Retrieved from the Internet <URL: http://www.ericbaere.com/catalogue.aspx>.

(Continued)

*Primary Examiner* — Eric Golightly
(74) *Attorney, Agent, or Firm* — Klintworth & Rozenblat IP LLC

(57) ABSTRACT

A method for cleaning a computer or typewriter keyboard with a cleaning device, wherein the keyboard includes a pair of keys spaced apart a distance $S_1$ from each other, and wherein the cleaning device includes a handle, a bristle retaining portion extending in a direction $d_1$ away from the handle, wherein the bristle retaining portion has a first end connected with the handle and an engagement area located on the bristle retaining portion at a point on the bristle retaining portion which is furthest from the handle, and a plurality of bristles connected with and extending from the bristle retaining portion at the engagement area, the method comprising: inserting the engagement area in between the keys.

20 Claims, 10 Drawing Sheets

U.S. PATENT DOCUMENTS

| | | | |
|---|---|---|---|
| D631,053 | S | 1/2011 | Bailey |
| D639,243 | S | 6/2011 | Gharib et al. |
| 2004/0129580 | A1 | 7/2004 | Cochran et al. |
| 2006/0090289 | A1 | 5/2006 | Kuang |
| 2007/0277342 | A1 | 12/2007 | Chen |
| 2010/0220451 | A1 | 9/2010 | Zaitz et al. |
| 2010/0319145 | A1 | 12/2010 | Neyer et al. |

OTHER PUBLICATIONS

DE 40306802-0001 Registered Design Application (Oral-Prevent Handelsgesellschaft MBH) Feb. 25, 2004; [online], [retrieved on Nov. 20, 2011]. Retrieved from Designs Register of the German Patent and Trade Mark Office using the internet; <URL: http://register.dmpa.de>.

USPTO , Notice for Design U.S. Appl. No. 29/366,872, dated Jan. 9, 2012.

Dentek "DenTek Easy Brush 10-count (Pack of 6)" http://www.amazon.com/DenTek-Easy-Brush-10-count-Pack/dp/B002WICK3M (accessed Mar. 29, 2011).

Butler "Butler Go Between Cleanrs Wide, Proxabrush, Size 8" http://www.amazon.com/Butler-Between-Cleanrs-Wide-Proxabrush/dp/B0047NJD8Q/ref=sr__1__1?ie=UTF8&s=hpc&qid=1302627421&sr=1-1 (Accessed Mar. 29, 2011).

Sunstar GUM? Proxabrush? Snap-Ons Refills Cylindrical—8 Count (622R) http://www.google.com/products/catalog?q=sunstar+interdental+brush&hl=en&um=1&ie=UTF-8&cid=16173157891432604808&sa=X&ei=noWkTdWhLtCP0QGn0KjxBA&ved=0CGAQ8wlwAA# (Accessed Mar. 29, 2011).

Sunstar.Butler Butler Go Betweens Angled Interdental Brush http://www.kleenteeth.com/mycategory.php? do=list&bname=GUM.Sunstar.Butler&cname=InterDental__Brushes (Accessed Mar. 29, 2011).

Sunstar "Proxabrush Trav-Ler-GUM-Butler-interdental brush-Dental" http://compare.ebay.com/like/270700820831?var=lv&Ityp=AllFixedPriceItemTypes&var=sbar&rvr__id=224641738506&crip=1__263602__309572&UA=WVI8&GUID=dd c7ecb112d0a0645c766336fef96efb&itemid=270700820831&ff4=263602__309572 Accessed Mar. 29, 2011).

Butler "Snap-On Handles and Refills" http://sale.dentist.net/products/butler-gum-proxabrush-snap-on-handles-and-refills (Accessed Mar. 29, 2011).

Sunstar "Gum Go-Betweens Proxabrush Cleaners, Tight 8 Count" http://www.planetrx.com/p/Gum-Go-Betweens-Proxabrush-Cleaners-Tight-8-count/224421.html? utm__source=frg&utm__medium=feed&utm__campaign=product&zmam=1000941&zmas=26&zmac=106&zmap=224421 (Accessed Mar. 29, 2011).

Butler "Proxabrush Trav-Ler, Tapered pocket-sized-Butler Dental" http://compare.ebay.com/like1270700820832? var=lv&Ityp=AllFixedPriceItemTypes&var=sbar&rvr__id=224637081481&crip=1 263602__309572&UA=WVI8&GUID=ddc7ecb112d0a064c50766336fef96efb&itemid=270700820832&ff4=263602__309572 (Accessed Mar. 29, 2011).

Computer Cleaner, Italy, picture taken 2010 Apr. 2011.

* cited by examiner

DEVICE AND METHOD FOR REMOVING PARTICULATES FROM A KEYBOARD

CROSS-REFERENCES TO RELATED APPLICATIONS

The Present application claims priority to U.S. Design Pat. application No. 29/366,872, filed 30 Jul. 2010, issued as D663124 on 10 Jul. 2012. The content of this U.S. Design Patent Application is hereby incorporated herein in its entirety.

FIELD OF THE INVENTION

The present invention relates generally to processes and devices for cleaning articles. More specifically, it relates to a brush for removing particulates and other matter from in between the keys of a keyboard.

BACKGROUND

Mechanical or electro-mechanical devices, hereinafter referred to as simply mechanical devices, having keys or buttons, such as calculators, cash registers, computer and typewriter keyboards, often have a thin space between the buttons or keys which may attract particulates and dust which get trapped in between and underneath the keys or buttons. It is often difficult to remove the particulates from in between and underneath the keys or buttons. One method for removing particulates and dust trapped between and underneath keys or buttons of a mechanical device requires using a traditional computer brush having bristles which extend directly from a handle and into the spacing between the keys. Since the bristles of the traditional computer brush extend generally in a primary direction $d_P$ that is perpendicular to a secondary direction $d_S$, where the secondary direction $d_S$ extends from a first key to a second key, the bristles of the traditional computer brush have some difficulty removing particulates and dust trapped underneath the keys or buttons, hereinafter referred to as simply keys, of a mechanical device.

Another method for removing particulates and dust trapped between and underneath keys of a mechanical device requires blowing compressed air on and in between the keys of a mechanical device. However, blowing compressed air often results in just moving the particulates and dust further underneath the keys and deeper into the mechanical device. Additional methods for removing particulates and dust trapped between and underneath keys of a mechanical device include the use of a cotton tipped member, such as a Q-Tip™, or towel wipes. However both the cotton tipped member and the towel wipes have difficulty reaching fully underneath the keys of the mechanical device. Vacuums may also be used to try and remove particulates and dust trapped between and underneath keys of a mechanical device, however, inevitably there is often dust and particulates which even the vacuum has difficulty removing.

As a result, it would be desirable to have an improved method and device for removing particulates and dust trapped between and underneath keys which is able to reach and remove the particulates and dust trapped in between and underneath keys.

SUMMARY

In one aspect, device for cleaning and removing particulates located in between and underneath a pair of keys for a mechanical device is provided. The device includes, but is not limited to, a handle, a bristle retaining portion extending in a direction $d_1$ away from the handle, and a plurality of bristles connected with and extending from the bristle retaining portion at the engagement area. The bristle retaining portion has a first end connected with the handle and an engagement area located on the bristle retaining portion at a point on the bristle retaining portion which is furthest from the handle. The engagement area has a thickness $t_1$ of less than 1 mm and greater than 0.5 mm. The thickness $t_1$ is measured in a direction $d_2$ which is generally perpendicular to the direction $d_1$ of the bristle retaining portion. The bristles form a brush. The brush has diameter of greater than 3 mm and less than 20 mm.

In one aspect, a method for cleaning a computer or typewriter keyboard is provided. The keyboard includes a pair of keys spaced apart a distance $S_1$ from each other. The method includes, but is not limited to inserting an engagement area of a cleaning device in between the keys and moving bristles of the cleaning device in between and under the keys to collect particulates which may be present. The cleaning device includes a handle, a bristle retaining portion extending in a direction $d_1$ away from the handle, and a plurality of bristles connected with and extending from the bristle retaining portion at the engagement area.

The bristle retaining portion has a first end connected with the handle and the engagement area located on the bristle retaining portion at a point on the bristle retaining portion which is furthest from the handle. The engagement area has a thickness $t_1$ which is less than the distance $S_1$. The thickness $t_1$ is measured in a direction $d_2$ which is generally perpendicular to the direction $d_1$ of the bristle retaining portion. The bristles form a brush. The brush has diameter of greater than 3 mm and less than 20 mm.

In one aspect, a method for cleaning a computer or typewriter keyboard with a cleaning device is provided. The keyboard includes a pair of keys spaced apart a distance $S_1$ from each other. The cleaning device includes a handle, a bristle retaining portion extending in a direction $d_1$ away from the handle, and a plurality of bristles connected with and extending from the bristle retaining portion at an engagement area. The bristle retaining portion has a first end connected with the handle and the engagement area located on the bristle retaining portion at a point on the bristle retaining portion which is furthest from the handle. The method includes, but is not limited to, inserting the engagement area in between the keys.

In one aspect, a device for displaying a visual imprint is provided. The device includes, but is not limited to, a handle having a narrow base portion and a widened gripping portion which provides enough area $A_1$ for a user to retain the handle and display a visual imprint, a retained member which is connected with the handle, and a base stand which is detachably coupled with the handle and forms an opening through which at least a portion of the retained member extends into. The widened gripping portion includes a display surface for receiving the visual imprint. At least a portion of the retained member is housed within the base stand. The retained member is one of a USB memory device, a brush, a touch screen stylus, a pen, a marker, a pencil or any other writing utensil, tweezers, or a light-based device such as a flash light or a laser pointer.

BRIEF DESCRIPTION OF THE DRAWINGS

The invention can be better understood with reference to the following drawings and description. The components in the figures are not necessarily to scale, emphasis instead being placed upon illustrating the principles of the invention.

DETAILED DESCRIPTION

Figure 3:
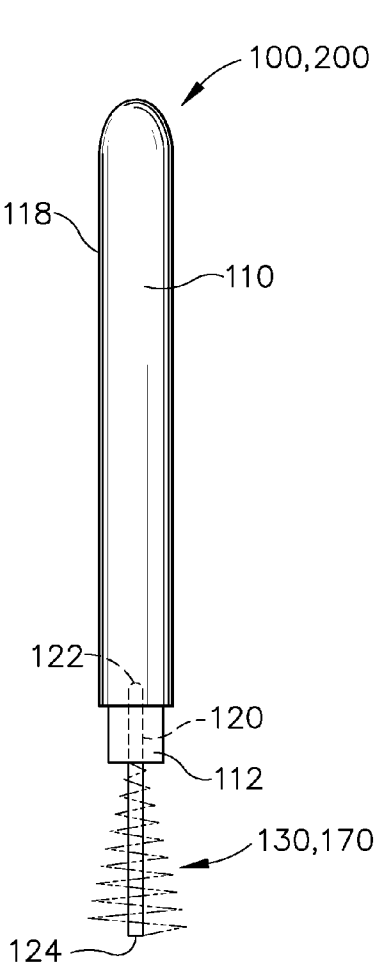
FIG. 3 depicts a rear elevational view of the device shown in FIG. 1, in accordance with one embodiment.

Methods and systems consistent with the present invention overcome the disadvantages of conventional brushes and keyboard cleaning systems by providing a cleaning device for cleaning and removing particles located in between and underneath a pair of keyboard keys having a handle, a bristle retaining portion extending in a direction $d_1$ away from the handle, and a plurality of bristles connected with and extending from the bristle retaining portion at an engagement area. The engagement area is located on the bristle retaining portion at a point on the bristle retaining portion which is furthest from the handle. The engagement area has a thickness $t_1$ which is less than a distance $S_1$ between a pair of adjacent keys on a keyboard. This allows the engagement area to be placed in between the keys of a keyboard. Additionally since the bristles extend from the bristle retaining portion at the engagement area in a variety of directions, the bristles are able to extend underneath the keys of the keyboard to remove particulates and dust trapped underneath the keys of the keyboard.

With reference to FIGS. 1-11, and 18 there is shown a device 100 for displaying a visual imprint 152. The device 100 can be a variety of devices, such as a cleaning device 200 used for cleaning a computer or typewriter keyboard 104, a storage device 300 for storing digital data such a USB memory device 302 having a USB connector 304, a touch screen stylus, a pen, a marker, a pencil or any other writing utensil, tweezers, a light-based device such as a flash light or a laser pointer. Preferably the device 100 is small enough in dimension and light enough in weight so as to be hand held, preferably by a pair of fingers, and displayed on a desktop of a user.

Figure 8:
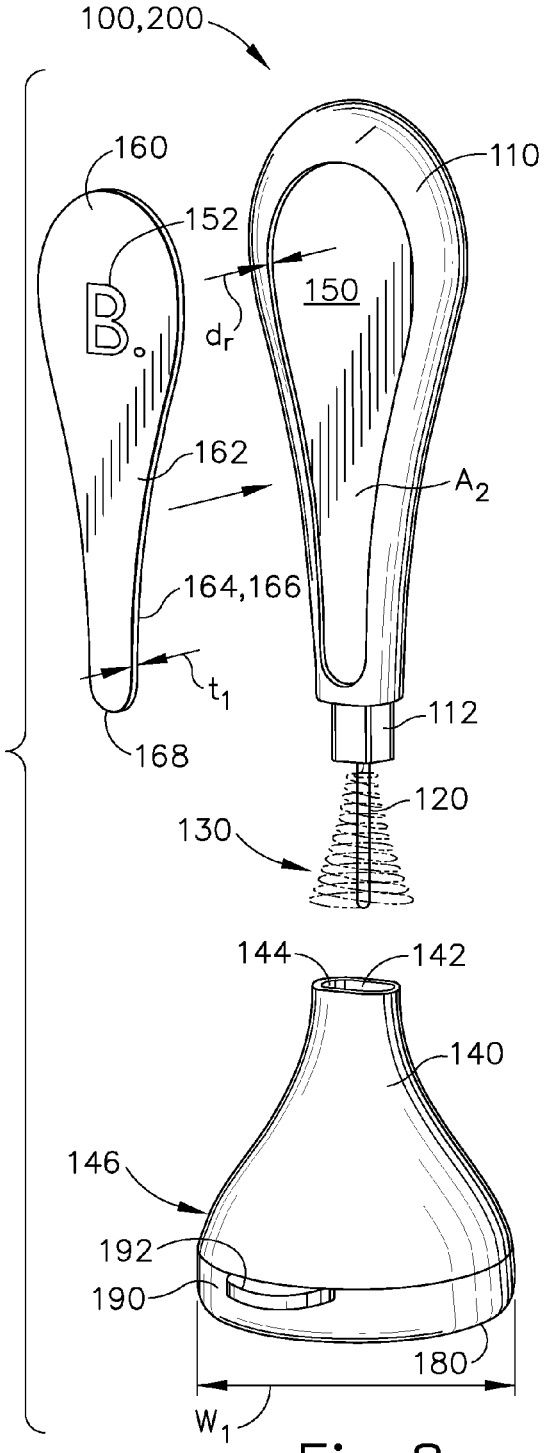
FIG. 8 depicts a front perspective view of a device for displaying a visual imprint detached from a base, in accordance with one embodiment.
Figure 9:
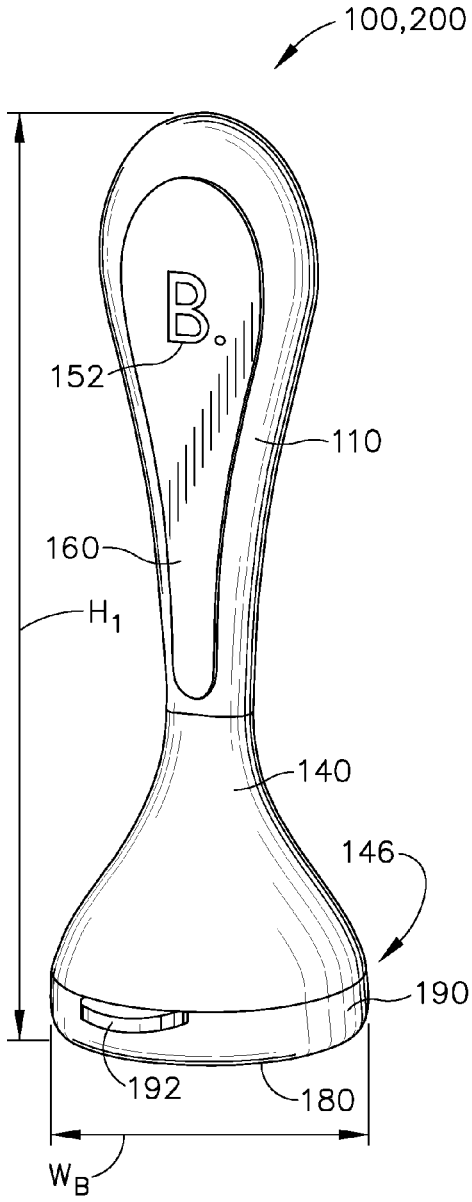
FIG. 9 depicts a front perspective view of the device shown in FIG. 8 attached with the base, in accordance with one embodiment.
Figure 10:
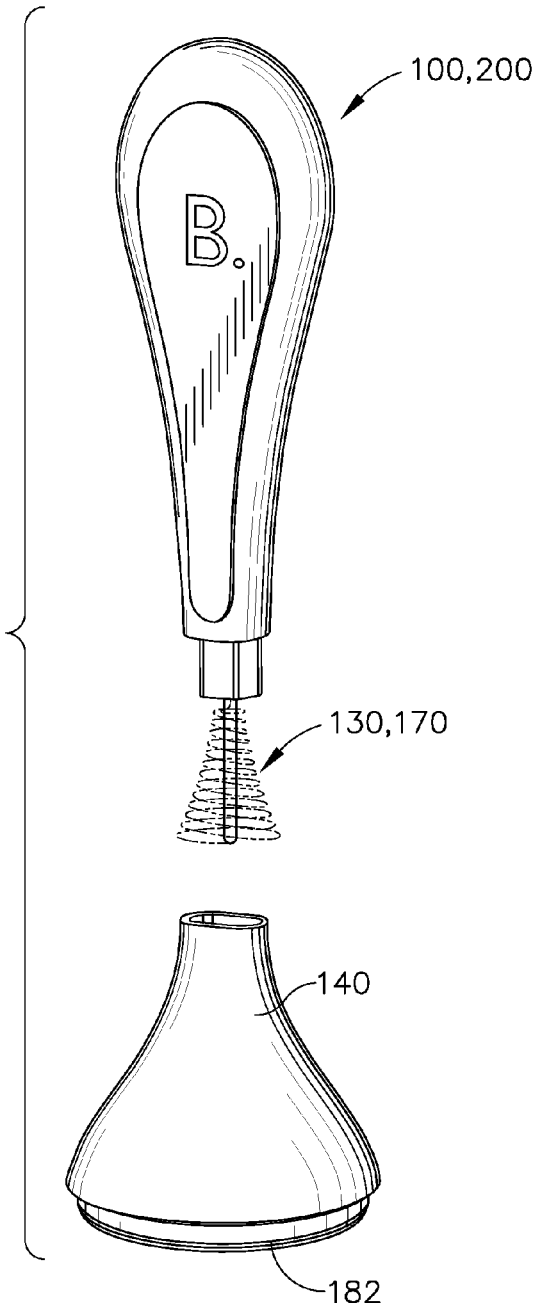
FIG. 10 depicts a front perspective view of the device shown in FIG. 8 without a protective cap around the base, in accordance with one embodiment.
Figure 11:
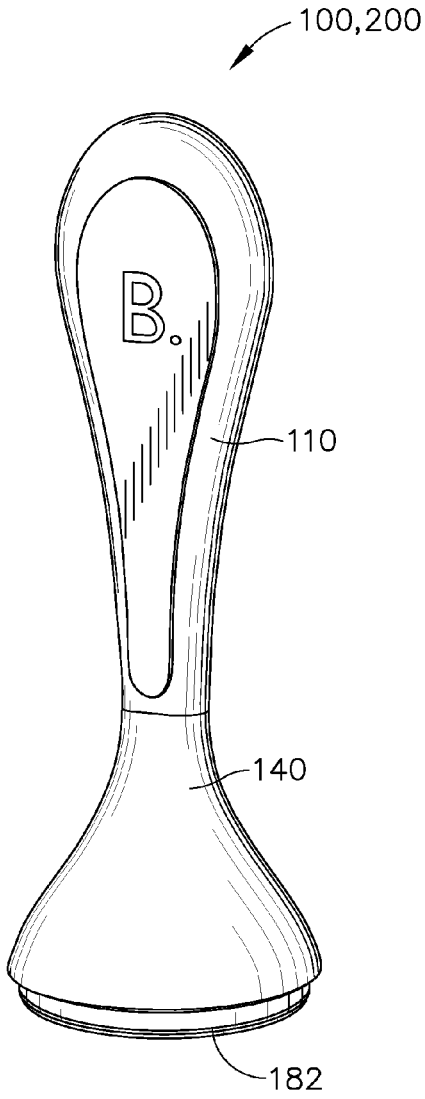
FIG. 11 depicts a front perspective view of the device shown in FIG. 9 without a protective cap around the base, in accordance with one embodiment.
Figure 12:
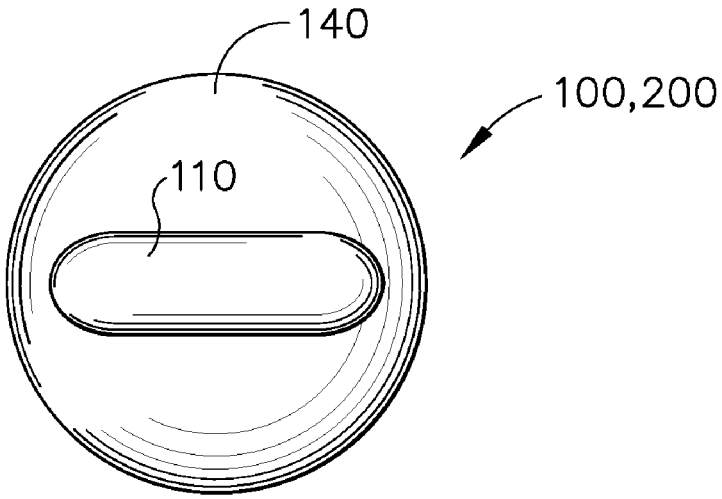
FIG. 12 depicts a top plan view of the device shown in FIG. 11, in accordance with one embodiment.
Figure 13:
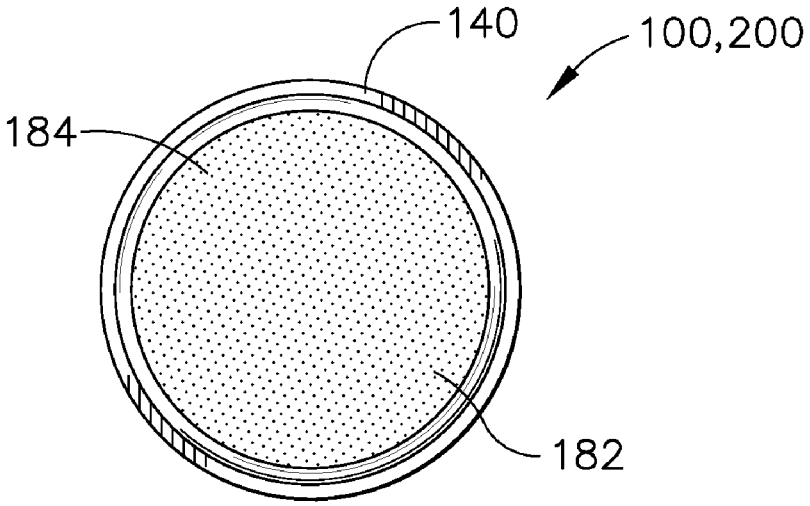
FIG. 13 depicts a bottom plan view of the device shown in FIG. 11, in accordance with one embodiment.

With reference to FIGS. 8 and 9, in one embodiment, the device 100 has a height $H_1$ from 50 mm to 250 mm, and preferably from 50 mm to 100 mm, so as to be displayed on a desktop of a user without cluttering the desk or blocking too many objects, such as a computer display screen. Preferably, the device 100 has a width $W_1$ at its widest point of between 15 mm and 100 mm, and more preferably of between 20 mm and 50 mm, so as to allow the device 100 to stand upright and be displayed on a desktop of a user without cluttering the desk or blocking too many objects. In one embodiment the device 100 has a weight from 5 grams to 250 grams, and more preferably from 10 grams to 100 grams, so that the device 100 is light enough for a user is able to lift the device 100 with a single hand and preferably with a pair of fingers.

Device 100 includes a handle 110 which is detachably coupled with a base stand 140, and a retained member 170 which is connected with the handle 110. As used herein, the term detachably coupled or detachably secured refers to coupling or securing a first member to a second member in a manner in which the two members are designed to be unfastened or disconnected from each other without damage to either member. This allows for a user to disconnect or unfasten the two members from each other without damage so that a user may service the two members or repeatedly use the two members independently from each other. Detachable couplings may include a snap-fit coupling, a frictionally engaging coupling which includes members which frictionally engage each other such as a rubber "O" ring which would frictionally engage the two members, a threaded coupling such as a screw and threaded engagement member, a magnetic coupling, a mechanical coupling such as a hook and loop type fastener.

Figure 2:
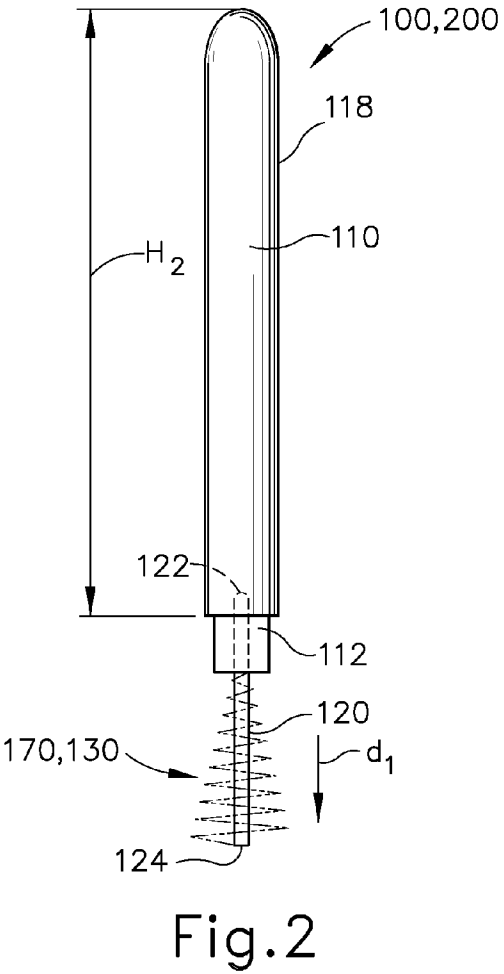
FIG. 2 depicts a front elevational view of the device shown in FIG. 1, in accordance with one embodiment.
Figure 1:
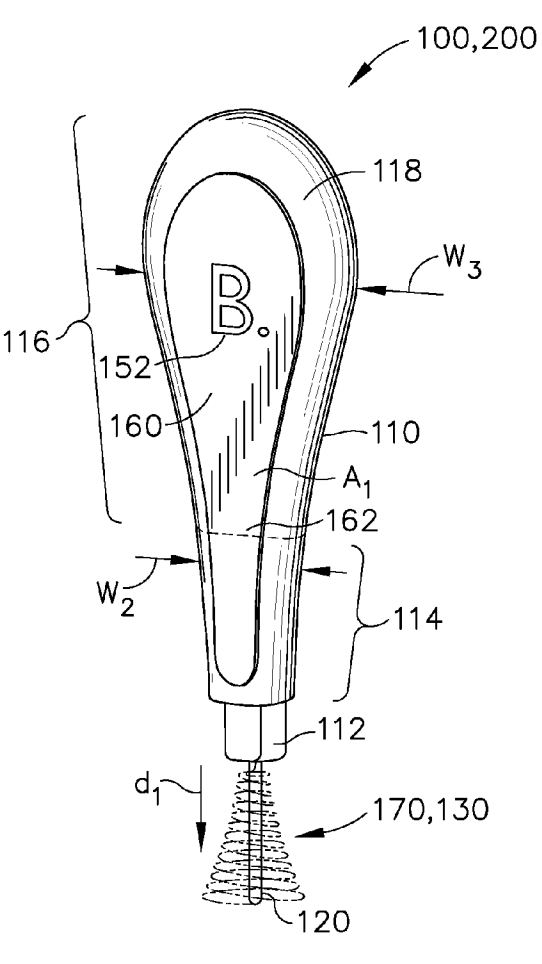
FIG. 1 depicts a front perspective view of a device for displaying a visual imprint, in accordance with one embodiment.
Figure 4:
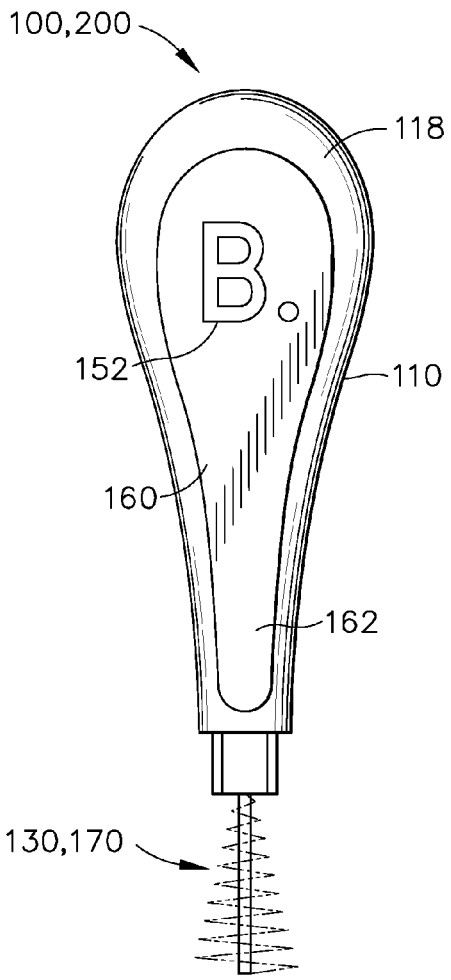
FIG. 4 depicts a right side elevational view of the device shown in FIG. 1, in accordance with one embodiment.

With reference to FIGS. 1-3, the handle 110 has a narrow base portion 114 which detachably couples to the base stand 140 and a widened gripping portion 116 which provides enough area $A_1$ for a user to retain the handle 110 and display a visual imprint 152. Preferably, the area $A_1$ is from 3 $cm^2$ to 50 $cm^2$, and more preferably from 3 $cm^2$ to 10 $cm^2$, and most preferably from 3 $cm^2$ to 8 $cm^2$. Preferably, the handle 110 has a height $H_2$ from 30 mm to 250 mm, and preferably from 30 mm to 100 mm, so as to be displayed on a desktop of a user without cluttering the desk or blocking too many objects, such as a computer display screen. Preferably, narrow base portion 114 has a width $W_2$ at its widest point of between 3 mm and 50 mm, and more preferably of between 5 mm and 40 mm, and the widened gripping portion 116 has a width $W_3$ at its widest point of between 10 mm and 100 mm, and more preferably of between 15 mm and 60 mm. The handle 110 is preferably made from a hardened, stiff material, such as a polymer, a rubber, a ceramic, a wood, or a metal.

With reference to FIGS. 8 and 9, the widened gripping portion 116 includes a display surface 150 for receiving a visual imprint 152. The display surface 150 has an area $A_2$ which is large enough to clearly display the visual imprint 152 from a distance of 1 cm to 50 cm from a user. Preferably, the area $A_2$ is from 3 $cm^2$ to 50 $cm^2$, and more preferably from 3 $cm^2$ to 10 $cm^2$, and most preferably from 3 $cm^2$ to 8 $cm^2$. Preferably, the display surface 150 is recessed a depth $d_r$ into the handle 110 from an outer surface 118 of the handle 110. Preferably, the depth $d_r$ is from 0.1 mm to 2 mm.

The visual imprint 152 may be any visually imprinted and displayed item, such as text, a symbol, a logo, a photo, or a work of art. Preferably, the visual imprint 152 is formed on a label 160 using either a printing process, an embossing process, or a silk-screening process, or any other process which may impart an image onto an object. The label 160 includes an imprinted surface 162 upon which the visual imprint 152 is imprinted upon and an inner surface which is affixed to the display surface 150. Preferably, the inner surface 164 of the label 160 is coated with an adhesive material 166 which is then placed in contact with the display surface 150, affixing the label 160 to the display surface 150. Preferably, the label 160 has a minimum thickness $t_1$ from 0.1 mm to 2 mm along an outer edge 168 of the label 160. Preferably, the thickness $t_1$ at the outer edge 168 of the label 160 is within ±0.5 mm of the depth $d_r$.

Figure 5:
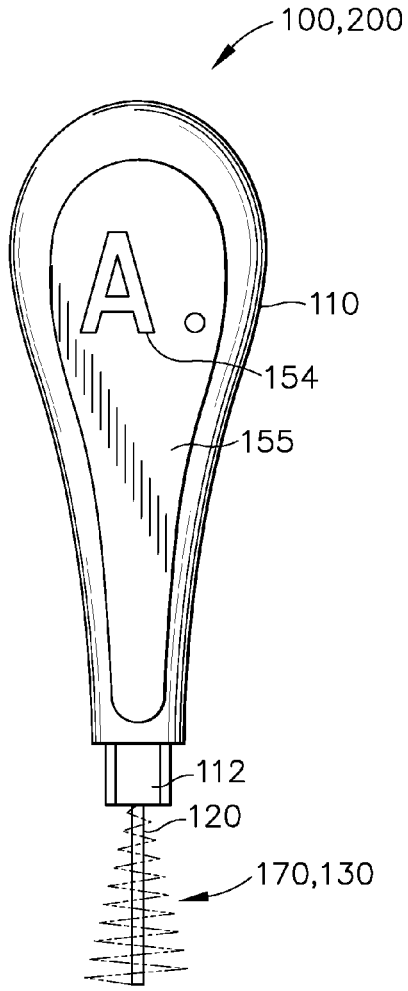
FIG. 5 depicts a left side elevational view of the device shown in FIG. 1, in accordance with one embodiment.
Figure 6:
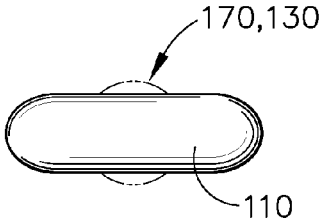
FIG. 6 depicts a top plan view of the device shown in FIG. 1, in accordance with one embodiment.
Figure 7:
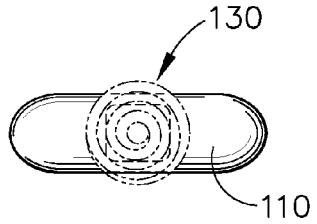
FIG. 7 depicts a bottom plan view of the device shown in FIG. 1, in accordance with one embodiment.

With reference to FIG. 5, the widened gripping portion 116 may include a second display surface 151 for receiving a second visual imprint 154. The second display surface 151 has an area $A_2$ which is large enough to clearly display the second visual imprint 154 from a distance of 1 cm to 50 cm from a user. Preferably, the area $A_2$ is from 3 $cm^2$ to 50 $cm^2$, and more preferably from 3 $cm^2$ to 10 $cm^2$, and most preferably from 3 $cm^2$ to 8 $cm^2$. Preferably, the second display surface 151 is recessed a depth $d_r$ into the handle 110 from an outer surface 118 of the handle 110. Preferably, the depth $d_r$ is from 0.1 mm to 2 mm.

The second visual imprint 154 may be any visually imprinted and displayed item, such as text, a symbol, a logo, a photo, or a work of art. Preferably, the second visual imprint 154 is formed on a second label 155 using either a printing process, an embossing process, or a silk-screening process, or any other process which may impart an image onto an object. The second label 155 includes an imprinted surface 157 upon which the second visual imprint 154 is imprinted upon and an inner surface which is affixed to the second display surface 151. Preferably, the inner surface of the second label 155 is coated with an adhesive material which is then placed in contact with the second display surface 151, affixing the second label 155 to the second display surface 151. Preferably, the second label 155 has a minimum thickness $t_1$ from 0.1 mm to 2 mm along an outer edge of the second label 155. Preferably, the thickness $t_1$ at the outer edge of the second label 155 is within ±0.5 mm of the depth $d_r$. A variety of substrates may be used for the labels 160, 155, including paper, plastic, labels with an adhesive backing, metal, natural materials such as wood, fabric, leather or suede, synthetic materials, synthetic fabrics, and spray finishes.

Preferably, the handle 110 houses at least a portion of the retained member 170 within a portion of the handle 110. By having a widened gripping portion 116, the handle 110 allows for a user to more easily grasp the handle 110 and allows for a display surface 150 which is large enough to receive and display a visual imprint 152 to a user.

The base stand 140 is detachably coupled with the handle 110 and forms an opening 142 through which at least a portion of the retained member 170 extends into. The base stand 140 is preferably made from a hardened, stiff material, such as a polymer, a rubber, a ceramic, a wood, or a metal. The base stand 140 preferably has a widened base portion 146 which allows for the base stand 140 to stand upright and for the base stand 140 to display and hold the handle 110 in an upright position. Preferably, the base stand has a width $W_B$ of between 15 mm and 100 mm, and more preferably of between 20 mm and 50 mm, so as to allow the device 100 to stand upright and be displayed on a desktop of a user. Preferably, the base stand 140 includes a generally flattened bottom portion 180 for maintaining the base stand 140 in a generally upright position and preventing the base stand 140 from tipping. Preferably, the width $W_B$ is greater than the widths $W_2$ and $W_3$ of the handle 110, so as to prevent the device 100 from tipping over.

With reference to FIGS. 10-13, in one embodiment, device 100 includes a screen cleaning device 182, preferably connected with the bottom portion 180 of the base stand 140. The screen cleaning device 182 may be any device which can be used to remove particulates and dust from a display screen, including a brush or a screen cleaning fabric, such as a cotton fabric, a microfiber fabric such as a fabric made from synthetic fibers that measure less than one denier, any soft cleaning fabric, any synthetic or natural fabric or material which can be used for cleaning glass or plastic surfaces without significantly scratching the surfaces, such as cotton. The microfiber fabric may be made from polyesters, polyamides (e.g., nylon, kevlar, nomex, trogamide), and or a conjugation of polyester and polyamide. Preferably, the screen cleaning device 182 is adhered to the bottom portion 180 with an adhesive, however, the screen cleaning device 182 may be connected with the bottom portion in a variety of different ways, such as by using a press-fit, a snap-fit, a fastener, or any other chemical or mechanical means for connecting two object together. In one embodiment, the screen cleaning device 182 is a microfiber fabric which is adhered on the bottom portion 180 using an adhesive.

With reference to FIGS. 8 and 9, in one embodiment, the device 100 includes a protective cap 190 covering the screen cleaning device 182 and detachably coupled with the base stand 140. The protective cap 190 is preferably formed of a flexible rubber-like material, such as a thermoplastic elastomer (TPE) or rubber, so as to better adhere to a smooth surface, such as a desk, and therefore, better retain the handle 110 in an upright position. Preferably, the protective cap 190 includes a tab 192 which allows for easier coupling and decoupling between the protective cap 190 and the base stand 140.

Figure 14:
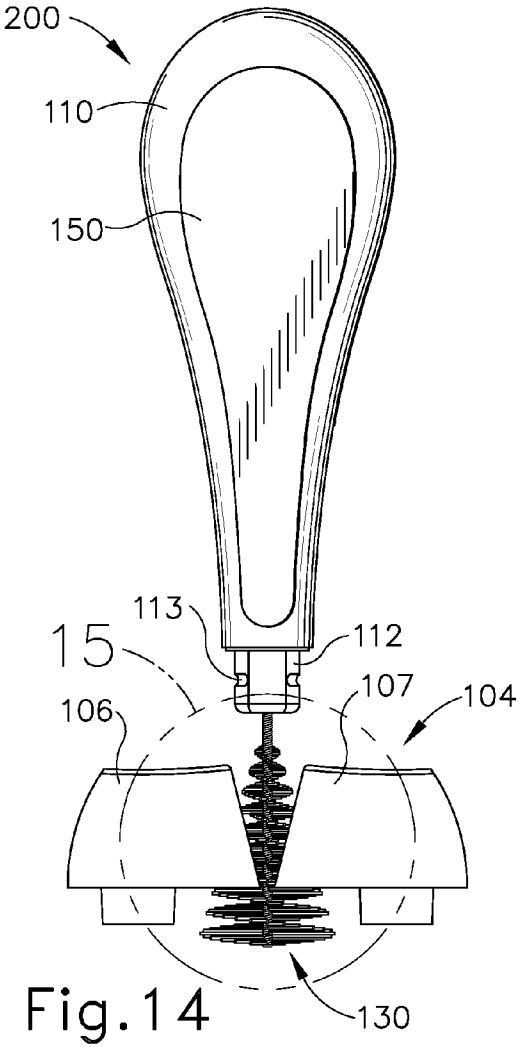
FIG. 14 depicts a left side elevational view of a cleaning device inserted in between a pair of keys, in accordance with one embodiment.

With reference to FIG. 8, in one embodiment, the base stand 140 includes a first engagement member 144 formed around the opening 142, and the handle 110 includes a complimentary second engagement member 112 which is detachably coupled with an mates with the first engagement member 144. With reference to FIGS. 8 and 14, in one embodiment, the engagement members 144, 112 include grooves 113 or bumps which are keyed into the outer surfaces of the engagement members 144, 112 to better couple the engagement members 144, 112 to each other. Preferably, the engagement members 144, 112 are shaped, using a keying or a unique shaping of the engagement members 144, 112, so as to be detachably coupled to each other in only a single position or in only one of two positions.

With reference to FIGS. 1-3, and 18, the retained member 170 is connected with the handle 110. Preferably the retained member 170 is fixedly connected with the handle 110, such as by being embedded within the handle 110, or connected with the handle using a fastener such as glue, a pressure fit arrangement, or a mechanical fastener such as a screw. The retained member is any device which can be embedded within and/or extended at least partially from the handle 110, and includes such things as a USB memory device, a brush, a touch screen stylus, a pen, a marker, a pencil or any other writing utensil, tweezers, or a light-based device such as a flash light or a laser pointer.

Figure 15:
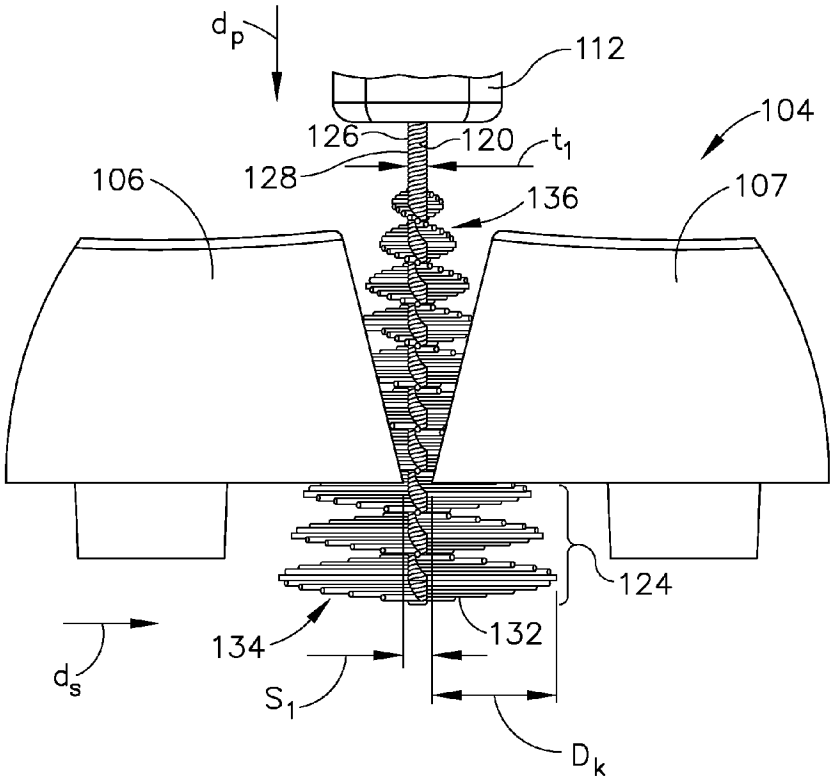
FIG. 15 depicts an enlarged left side elevational view of the cleaning device shown in FIG. 14 within circle A, in accordance with one embodiment.
Figure 16:
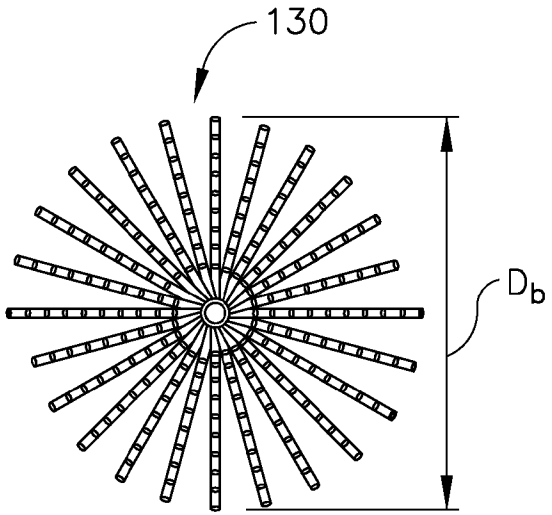
FIG. 16 depicts a bottom plan view of a brush of the cleaning device shown in FIG. 14, in accordance with one embodiment.
Figure 18:
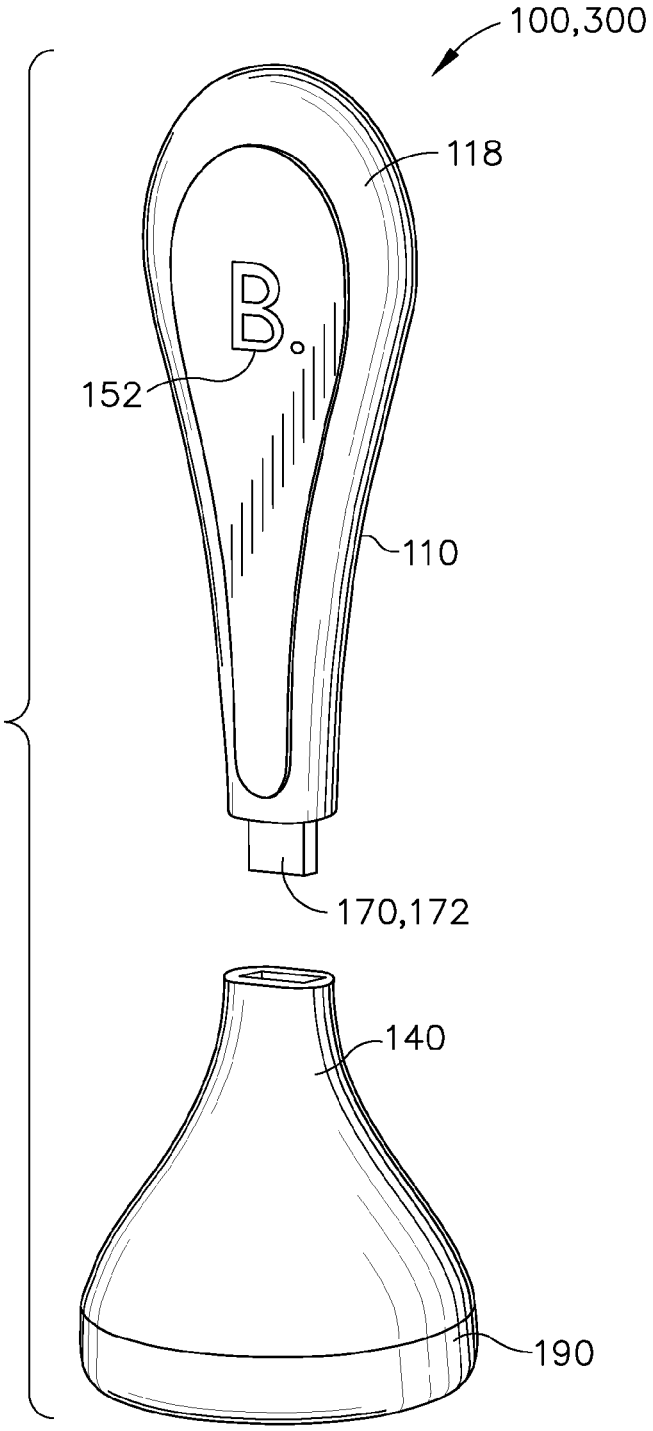
FIG. 18 depicts a front perspective view of a device for displaying a visual imprint detached from a base, in accordance with one embodiment.

With reference to FIGS. 1-3, and 14-17, in one embodiment, the device 100 is a cleaning device 200, wherein the retained member 170 is a brush 130. The brush 130 includes a bristle retaining portion 120 and a plurality of bristles 132 connected with and extending from the bristle retaining portion 120. The bristle retaining portion 120 is any elongated member to which bristles 132 can be connected to or affixed onto. In one embodiment, the bristle retaining portion 120 comprises a single twisted wire 126 or a pair of twisted wires 126, 128 which are twisted upon each other, and through which bristles 132 are placed and attached as the wires 126, 128 are being twisted. The resulting twisted wire structure of the bristle retaining portion 120 captures and hold the bristles 132 in place, as shown in FIG. 16. Preferably, the thickness of each wire 126, 128 is between 0.1 mm and 0.75 mm, and more preferably between 0.2 mm and 0.5 mm, and most preferably about 0.4 mm±0.1 mm. Preferably, the bristle retaining portion 120 is made from a strong yet flexible material, such as: a metal like steel, stainless steel, brass, titanium, nickel, and aluminum; a carbon based material such as carbon fiber; and a polymer-based material such as plastic. In one embodiment, the bristle retaining portion 120 is made from steel, and preferably 28 gage stainless steel wire.

Figure 19C:
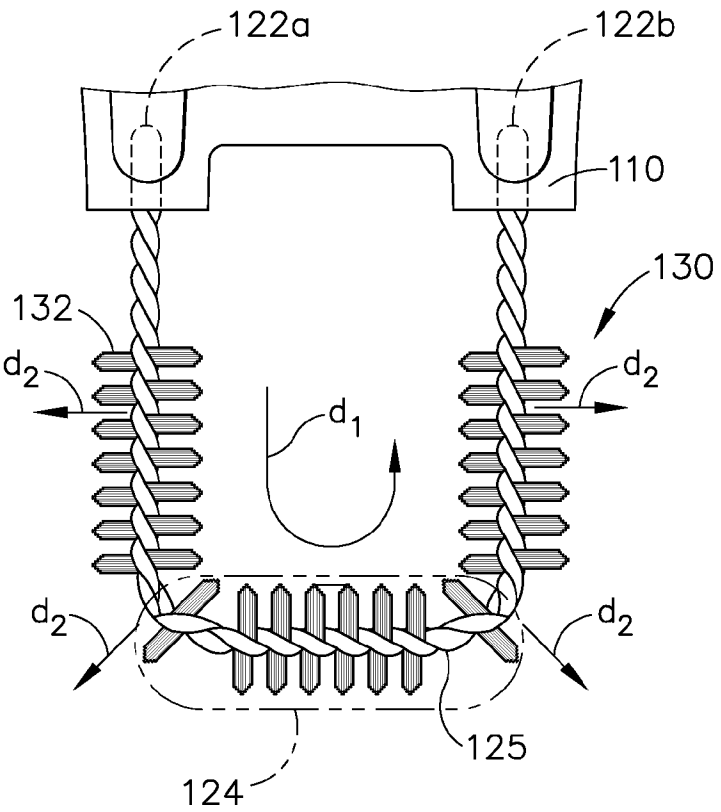
FIGS. 19A, 19B, 19C, 19D, and 19E depict various left side elevational views of various brushes for use with a cleaning device, each view in accordance with one embodiment.
Figure 19B:
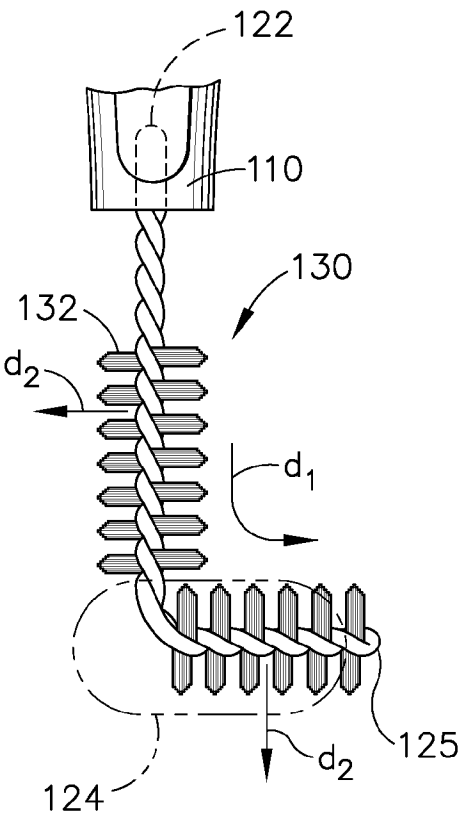
Figure 19A:
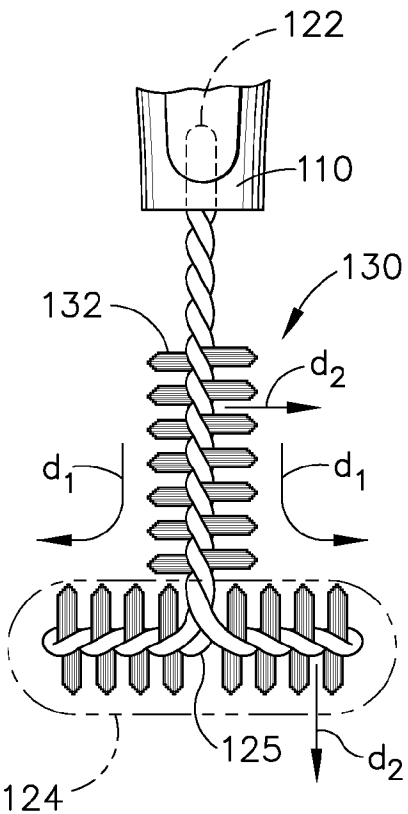
Figure 19E:
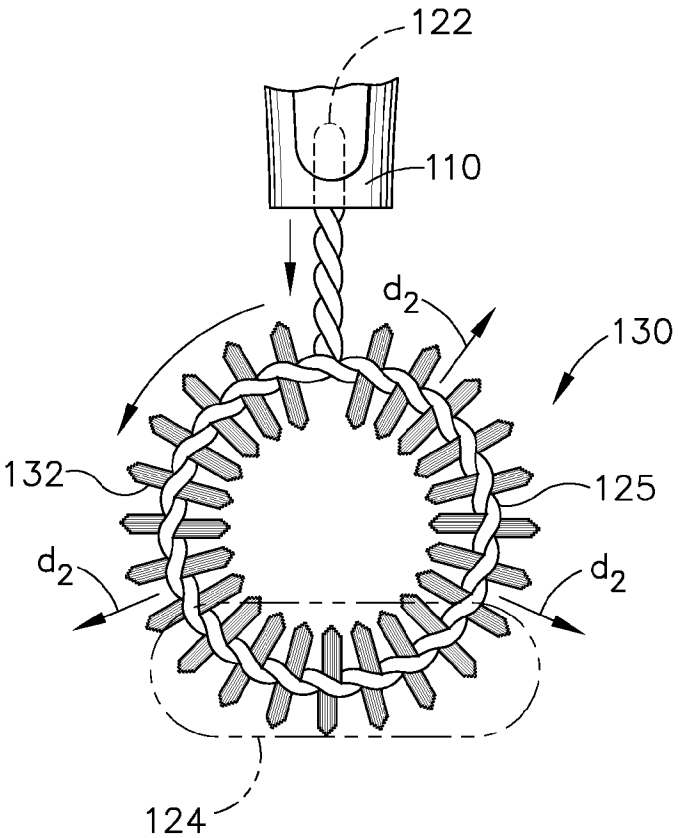
Figure 19D:
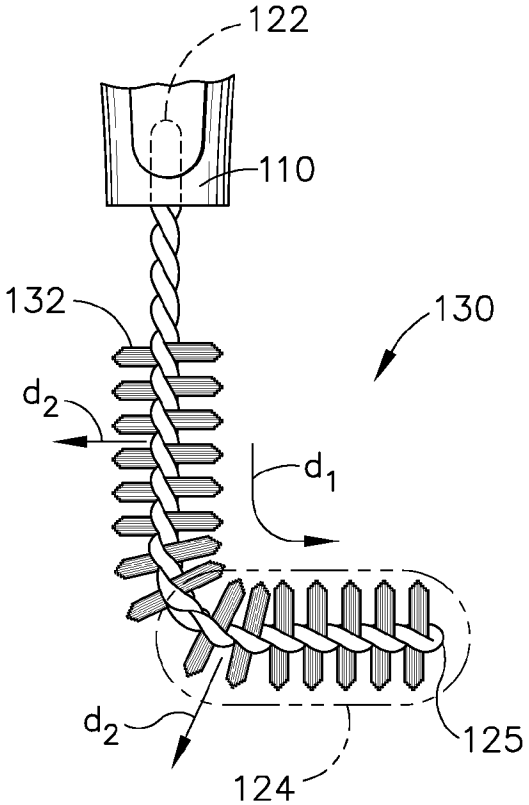

With reference to FIGS. 1 and 19A-19E, the bristle retaining portion 120 extends in a direction $d_1$ away from the handle 110. The bristle retaining portion 120 has a first end 122, or a pair of first ends 122*a*, 122*b*, as shown in FIG. 19C, which is connected with the handle 110 and an engagement area 124 located on the bristle retaining portion 120 at a point 125 on the bristle retaining portion 120 which is furthest from the handle 110. The engagement area 124 engages the device or object which the brush 130 is designed to clean, such as a keyboard 104, as shown in FIGS. 14 and 15, and contains point 125 which is furthest from the handle 110 and on the bristle retaining portion 120.

Figure 17:
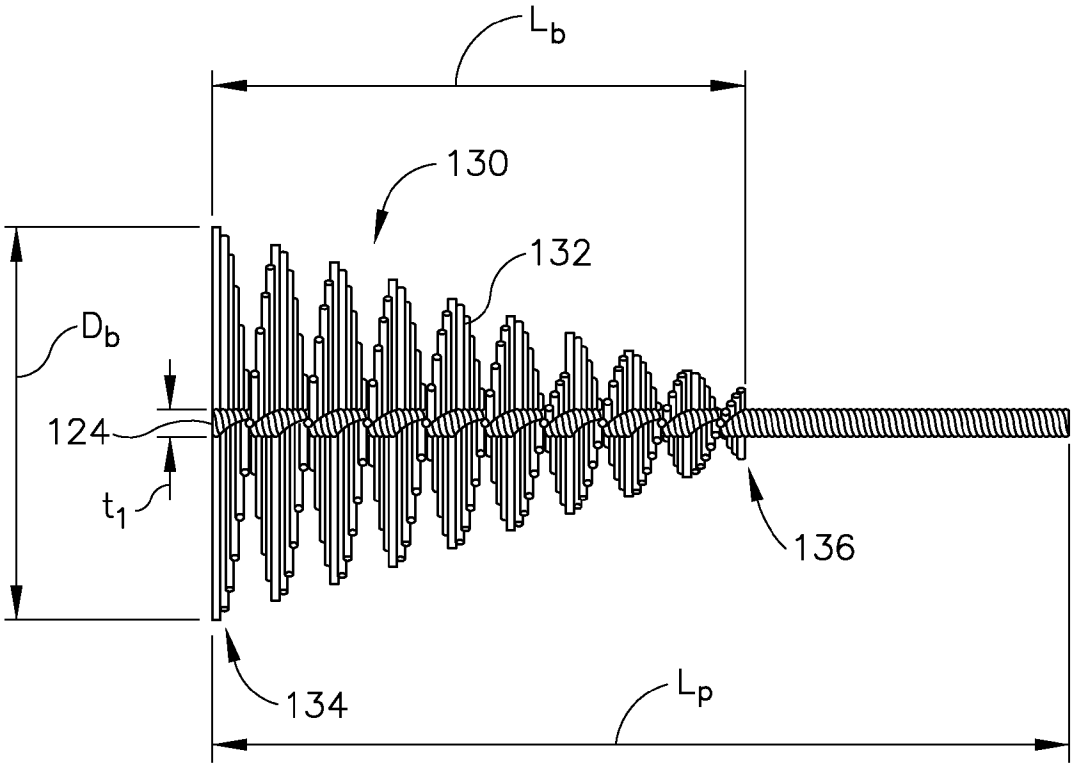
FIG. 17 depicts a left side elevational view of the brush of the cleaning device shown in FIG. 14, in accordance with one embodiment.

With reference to FIGS. 15 and 17, preferably, the engagement area 124 of the bristle retaining portion 120 has a thickness $t_1$ from 1.5 mm to 0.1 mm, and more preferably from 1 mm to 0.5 mm, and more preferably of less than 1 mm and greater than 0.5 mm, and most preferably of 0.8 mm±0.2 mm. The thickness $t_1$ is measured in a direction $d_2$ which is generally perpendicular to the direction $d_1$ of the bristle retaining portion 120.

With reference to FIGS. 1 and 19A-E, the bristle retaining portion 120 may form one of a generally straight member (FIG. 1), a T-shaped member (FIG. 19A), an L-shaped member (FIG. 19B), a curved u-shaped member (FIG. 19C), a curved j-shaped member (FIG. 19D), or a curved o-shaped member (FIG. 19E) to better clean the device of object being cleaned, such as a keyboard 104.

With reference to FIGS. 1 and 17, in one embodiment, the bristle retaining portion 120 forms a generally straight member and the brush 130 is conically shaped and forms a brush base 134 opposed to a brush tip 136. The brush base 134 is at the engagement area 124 and has a diameter $D_b$ of greater than 3 mm and less than 20 mm. The brush tip 136 is located on the bristle retaining portion 120 a distance away from the brush base 134.

The bristles 132 form brush 130 and define a brush diameter $D_b$ for the brush 130 that is preferably greater than 3 mm and less than 20 mm, and more preferably, greater than 5 mm and less than 15 mm, and most preferably about 11.5 mm±2 mm. If the brush diameter $D_b$ is too great than the brush 130 will have difficulty fitting in between spaces formed between keys 106, 107 of keyboard 104. If the brush diameter $D_b$ is too small, then the brush 130 will not be able to effectively clean and remove particulates between and under the keys 106, 107 of keyboard 104. Preferably, the bristles 132 are formed from a soft flexible material such as any polymer, nylon, polypropylene, and acrylonitrile butadiene styrene (ABS), having a thickness from 0.1 mm to 1 mm, and preferable from 0.1 mm to 0.3 mm.

Each bristle 132 has a length $L_b$ of approximately half the brush diameter $D_b$. The longest bristles are preferably formed at the base of the brush 130 at the engagement area 124, and have a length $L_b$ that is preferably greater than 1.5 mm and less than 10 mm, and more preferably, greater than 2.5 mm and less than 7.5 mm, and most preferably about 6.25 mm±1 mm. Preferably, bristles 132 at the engagement area 124 have a length $L_b$ that is not too long, allowing for the bristles 132 to expand fully once the bristle retaining portion 120 is placed in between the spaces formed in between keys 106, 107, as shown in FIG. 15. Preferably, bristles 132 at the engagement area 124 have a length $L_b$ that is not too short as well, allowing for the bristles 132 to reach a distance $D_k$ away from the bristle retaining portion 120 and under the keys 106 when the bristle retaining portion 120 is placed in between the spaces formed in between keys 106, 107, as shown in FIG. 15. Preferably, twice the distance $D_k(2 \cdot D_k)$ is equal to or greater than 50% of the distance $D_1$ between keys base portions 206, 207, and preferably equal to or greater than 75% of the distance $D_1$ between keys base portions 206, 207, and preferably greater than 90% of the distance $D_1$ between keys base portions 206, 207. In this manner, the bristles 132 at the engagement area 124 are long enough so as to cover as much area under the keys 106, 107 as possible, but short enough to allow them to expand fully and be generally perpendicular to the bristle retaining portion 120 once the bristle retaining portion 120 is placed in between the spaces formed in between keys 106, 107.

Bristles 132 extend from the bristle retaining portion 120. Preferably, the bristles 132 extend from the bristle retaining portion 120 at the engagement area 124 in any one of a variety of different directions. As a result, the bristles 132 are able to extend underneath the keys 106, 107 of the keyboard 104 to remove particulates and dust trapped underneath the keys 106, 107 of the keyboard 104.

In one embodiment, at least some of the bristles 132 are connected with and extending in a direction $d_2$ from the bristle retaining portion 120. Direction $d_2$ is generally perpendicular to the first direction $d_1$. As used herein, the term generally perpendicular refers to a direction that is preferably from 60° to 120° that of the first direction $d_1$, and more preferably from 70° to 110° that of the first direction $d_1$, and most preferably from 80° to 100° that of the first direction $d_1$. In this manner, the bristles 132 are able to reach in between and underneath objects such as keys 106, 107 of a keyboard 104.

With reference to FIGS. 14 and 15, in one embodiment, at least some of the bristles 132 which are formed on the engagement area 124 extend generally in a secondary direction $d_S$ when the bristles retaining portion 120 is placed in between the keys 106 and 107. In this manner, when the bristles retaining portion 120 is placed in between the keys 106 and 107, some of the bristles 132 are able to extend in the secondary direction $d_S$ and reach underneath the keys. The secondary direction $d_S$ is defined as being generally parallel to any vector which extends from the first key 106 to the second key 107, or any vector within a plane which encompasses a vector that extends from the first key 106 to the second key 107. As defined herein, the term generally parallel is defined as parallel to within ±30°, and preferably to within ±20°.

With reference to FIGS. 8 and 9, preferably, the brush 130 and handle 110 are detachable coupled to a base stand 140 which forms an opening 142 through which the bristle retaining portion 120 and the brush 130 extend into. Preferably, at least a portion of the bristle retaining portion 120 is housed within the base stand 140. In this manner, the handle 110 is able to be displayed in an upright position and the bristles 132 of the brush 130 are able to be shielded and protected by the base stand 140. Preferably, the base stand 140 includes a first engagement member 144 formed around the opening 142, and the handle 110 includes a complimentary second engagement member 112 which mates with the first engagement member 144 to allow for improved engagement between the base stand 140 and the handle 110.

With reference to FIGS. 14-15, the cleaning device 200 may be used to clean a computer or typewriter keyboard 104. The keyboard 104 includes a pair of keys 106, 107 spaced apart a distance $S_1$ from each other. Preferably, the thickness $t_1$ of the bristle retaining portion 120 is less than the distance $S_1$ to allow for the bristle retaining portion 120 and the bristles 132 to be inserted in between the keys 106, 107. In use, the engagement area 124 of the cleaning device 200 is first inserted in between the keys 106, 107. Then bristles 132 are moved in between and under the keys 106, 107 in order to collect particulates which may be present either in between or under the keys 106, 107, unlike traditional brushes which may be used to clean keyboards and which have a hard time placing bristles underneath the keys 106, 107 and removing particulates trapped underneath the keys 106, 107. Upon moving the bristles 132 in between and under the keys 106, 107, the cleaning device 200 is then removed from in between the keys 106, 107 by pulling the handle 110 up and away from the keys 106, 107.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While various embodiments of the invention have been described, it will be apparent to those of ordinary skill in the art that other embodiments and implementations are possible within the scope of the invention. Accordingly, the invention is not to be restricted except in light of the attached claims and their equivalents.

The invention claimed is:

1. A method for cleaning a computer or typewriter keyboard, wherein the keyboard includes a pair of keys spaced apart a distance $S_1$ from each other, the method comprising:

inserting an engagement area of a cleaning device in between the keys, wherein the cleaning device includes:

a handle, a bristle retaining portion extending in a direction $d_1$ away from the handle, wherein the bristle retaining portion has a first end connected with the handle and the engagement area located on the bristle retaining portion at a point on the bristle retaining portion which is furthest from the handle, wherein the engagement area has a thickness $t_1$ which is less than the distance $S_1$, and wherein the thickness $t_1$ is measured in a direction $d_2$ which is generally perpendicular to the direction $d_1$ of the bristle retaining portion, and a plurality of bristles connected with and extending from the bristle retaining portion at the engagement area, wherein the bristles form a brush, wherein the brush has diameter of greater than 3 mm and less than 20 mm; and moving the bristles in between and under the keys to collect particulates which may be present.

2. The method of claim 1 further comprising removing the cleaning device from in between the keys.

3. The method of claim 1, wherein the thickness $t_1$ is less than 1 mm and greater than 0.5 mm.

4. The method of claim 1, wherein the bristle retaining portion forms one of a generally straight member, a T-shaped member, an L-shaped member, a curved u-shaped member, a curved j-shaped member, or a curved o-shaped member.

5. The method of claim 1, wherein the bristles are formed from a polymer and have a thickness of between 0.1 mm and 0.3 mm.

6. The method of claim 4, wherein the bristle retaining portion forms a generally straight member, wherein the brush is conically shaped and forms a brush base opposed to a brush tip, wherein the brush base is at the engagement area and has a diameter of greater than 3 mm and less than 20 mm, and wherein the brush tip is located on the bristle retaining portion a distance away from the brush base.

7. The method of claim 1, wherein the plurality of bristles are connected with and extending in the direction $d_2$ from the bristle retaining portion, and wherein the direction $d_2$ is generally perpendicular to the first direction $d_1$.

8. The method of claim 1, wherein the bristle retaining portion includes a twisted wire or a pair of twisted wires.

9. The method of claim 8, wherein each wires has a thickness $t_2$ of 0.2 mm to 0.5 mm in order to fit in a space formed between the pair of keyboard keys.

10. A method for cleaning a computer or typewriter keyboard with a cleaning device, wherein the keyboard includes a pair of keys spaced apart a distance $S_1$ from each other, and wherein the cleaning device includes a handle, a bristle retaining portion extending in a direction $d_1$ away from the handle, wherein the bristle retaining portion has a first end connected with the handle and an engagement area located on the bristle retaining portion at a point on the bristle retaining portion which is furthest from the handle, and a plurality of bristles connected with and extending from the bristle retaining portion at the engagement area, the method comprising:

inserting the engagement area in between the keys.

11. The method of claim 10 further comprising moving the bristles in between and under the keys to collect dust or other particulates which may be present.

12. The method of claim 10, wherein the engagement area has a thickness $t_1$ which is less than the distance $S_1$, and wherein the thickness $t_1$ is measured in a direction $d_2$ which is generally perpendicular to the direction $d_1$ of the bristle retaining portion.

13. The method of claim 12, wherein the thickness $t_1$ is less than 1 mm and greater than 0.5 mm.

14. The method of claim 10, wherein the bristles form a brush, wherein the brush has diameter of greater than 3 mm and less than 20 mm.

15. The method of claim 10 further comprising removing the cleaning device from in between the keys.

16. The method of claim 10, wherein the bristle retaining portion forms one of a generally straight member, a T-shaped member, an L-shaped member, a curved u-shaped member, a curved j-shaped member, or a curved o-shaped member.

17. The method of claim 10, wherein the bristles are formed from a polymer and have a thickness of between 0.1 mm and 0.3 mm.

18. The method of claim 16, wherein the bristle retaining portion forms a generally straight member, wherein the brush is conically shaped and forms a brush base opposed to a brush tip, wherein the brush base is at the engagement area and has a diameter of greater than 3 mm and less than 20 mm, and wherein the brush tip is located on the bristle retaining portion a distance away from the brush base.

19. The method of claim 10, wherein the plurality of bristles are connected with and extending in a direction $d_2$ from the bristle retaining portion, and wherein the direction $d_2$ is generally perpendicular to the first direction $d_1$.

20. The method of claim 10, wherein the bristle retaining portion includes a twisted wire or a pair of twisted wires.

* * * * *